US006994057B2

(12) United States Patent
Loth et al.

(10) Patent No.: US 6,994,057 B2
(45) Date of Patent: Feb. 7, 2006

(54) COMPRESSION IGNITION ENGINE BY AIR INJECTION FROM AIR-ONLY CYLINDER TO ADJACENT AIR-FUEL CYLINDER

(76) Inventors: John L. Loth, P.O. Box 4094, Morgantown, WV (US) 26504; Gary J. Morris, 2026 Glenmark Ave., Morgantown, WV (US) 26505

( * ) Notice: Subject to any disclaimer, the term of this patent is extended or adjusted under 35 U.S.C. 154(b) by 0 days.

(21) Appl. No.: 10/793,583

(22) Filed: Mar. 4, 2004

(65) Prior Publication Data

US 2005/0199191 A1 Sep. 15, 2005

(51) Int. Cl.
*F02B 11/00* (2006.01)

(52) U.S. Cl. ..... 123/27 R; 123/70 R

(58) Field of Classification Search ..... 123/26, 123/27 R, 25 C, 317
See application file for complete search history.

(56) References Cited

U.S. PATENT DOCUMENTS

| | | | | |
|---|---|---|---|---|
| 1,904,775 | A * | 4/1933 | Bartholomew | 60/620 |
| 2,058,705 | A * | 10/1936 | Maniscalco | 123/72 |
| 3,623,463 | A * | 11/1971 | De Vries | 123/70 R |
| 3,675,630 | A * | 7/1972 | Stratton | 123/70 R |
| 3,774,581 | A * | 11/1973 | Lundy | 123/70 R |
| 3,863,613 | A * | 2/1975 | Petrie | 123/26 |
| 3,880,126 | A * | 4/1975 | Thurston et al. | 123/70 R |
| 4,314,539 | A | 2/1982 | Schade | |
| 5,239,959 | A | 8/1993 | Loth | |
| 5,309,713 | A | 5/1994 | Vassallo | |
| 5,325,824 | A | 7/1994 | Wishart | |
| 5,381,760 | A | 1/1995 | Simonds | |
| 6,223,729 | B1 | 5/2001 | Matsuda et al. | |
| 6,227,171 | B1 | 5/2001 | Matsuda | |
| 6,338,328 | B1 * | 1/2002 | Mower et al. | 123/317 |
| 6,340,004 | B1 * | 1/2002 | Patton | 123/25 C |
| 6,343,596 | B1 | 2/2002 | Hajji et al. | |
| 6,484,673 | B1 | 11/2002 | Davis et al. | |
| 6,640,773 | B2 | 11/2003 | Ancimer et al. | |
| 6,651,432 | B1 | 11/2003 | Gray | |
| 6,662,760 | B1 | 12/2003 | Stanglmaier et al. | |
| 6,666,185 | B1 | 12/2003 | Willi et al. | |
| 6,789,514 | B2 * | 9/2004 | Suh et al. | 123/70 R |

FOREIGN PATENT DOCUMENTS

| | | |
|---|---|---|
| GB | 1380941 | 6/1921 |

* cited by examiner

*Primary Examiner*—Henry C. Yuen
*Assistant Examiner*—Arnold Castro

(57) ABSTRACT

The internal combustion engine relies on air injection for ignition instead of Otto cycle spark or Diesel cycle fuel injection. Cylinder pairs are connected by a cylinder-connecting valve, which opens near top-dead-center on the compression stroke injecting high-pressure air from one cylinder into a second cylinder containing an air-fuel mixture thereby inducing detonation ignition at top-dead-center. During the expansion stroke, the cylinder-connecting valve remains open and provides equal pressure on both cylinders, which is substantially higher than possible in an Otto cycle. Constant volume heat addition makes this engine more efficient than the Diesel cycle. Compared to conventional engines, the absence of spark ignition or high pressure fuel injectors makes this engine more economical, more reliable, and scalable down to small sizes where fuel metering limitations of Diesel fuel injectors become problematic. The engine can serve as a reactor for generating high temperature hydrogen to power high temperature fuel cells.

20 Claims, 5 Drawing Sheets

COMPRESSION IGNITION ENGINE BY AIR INJECTION FROM AIR-ONLY CYLINDER TO ADJACENT AIR-FUEL CYLINDER

CROSS-REFERENCE TO RELATED APPLICATIONS

"Compression Ignition by Air Injection Cycle and Engine, USPTO Ser. No. 10/755,134 filed Jan. 9, 2004"

STATEMENT REGARDING FEDERALLY SPONSORED RESEARCH AND DEVELOPMENT

"not-applicable"

FIELD OF THE INVENTION

This invention relates to a new IC engine configuration and operation to improve fuel economy, increase reliability and reduce maintenance and manufacturing cost. When applied to two-stroke engines it also improves cylinder scavenging and prevents unburned fuel from escaping through the exhaust ports. The ignition simplification lays in the fact that conventional IC engines rely on spark plugs or high-pressure fuel pumps with direct cylinder injection. Ignition is timed by opening the cylinder-connecting valve (CCV). A valve actuator is used, near the end of the compression stroke, to allow high-pressure air from one cylinder to inject into the neighboring cylinder, which is filled with a combustible air-fuel mixture or just fuel such as hydrogen or methane. The increase in thermal efficiency over the Otto cycle lays in the fact that detonating a combustible mixture by adding high-pressure air increases the pressure of the combustion products throughout the entire expansion stroke. The increase in thermal efficiency over the Diesel cycle lays in the fact that an air-fuel mixture can be detonated by high-pressure air injection. The result is constant volume heat addition near top dead center instead of near constant pressure heat addition prior to fuel cut-off well after top dead center. This IC engine may be combined with a high temperature fuel cell to yield a system, which is highly efficient at converting hydrogen-based fuel energy to electrical energy and shaft energy.

The thermodynamic cycle for this invention was calculated and named CIBAI, short for: Compression Ignition By Air Injection. See patent application USPTO Ser. No. 10/755,134 titled: Compression Ignition By Air Injection Cycle and Engine.

BACKGROUND OF THE INVENTION

All currently operating internal combustion piston engines operating on the Otto cycle have their compression ratio and thus thermal efficiency limited by the fuel octane number. To prevent pre-ignition or detonation before top dead center the compression ratio is usually limited within the range from 8 to 11. Its compression ratio and thus thermal efficiency is further reduced when operated at less than full power because then a throttle valve is needed to maintain a near stoichiometric fuel-air mixture for efficient spark ignition.

All currently operating internal combustion piston engines, which operate on the Diesel cycle, have their thermal efficiency limited by near constant pressure heat addition during the combustion event which is quantified by the ratio of the cylinder volume at the end of combustion to the cylinder volume at the top dead center, called cut-off ratio ($r_c$). This is determined by the time required for fuel injection and burning rate or cetane number. Compression ignition in the Diesel engine allows operation over a wide range of fuel-air ratios therefore a throttle valve is not required. Its thermal efficiency decreases with power level, as high power requires a larger cut-off ratio, which is contrary to the Otto cycle where the thermal efficiency increases with throttle opening and thus power level.

The Diesel engine cold starting problem is caused by increased fuel viscosity resulting in poor fuel injector atomization. Further the lower temperature of the air inside the cylinder reduces the fuel vaporization rate and thus ignitability.

SUMMARY OF THE INVENTION

Compression Ignition By Air Injection Cycle and Engine is hereafter referred to as the CIBAI cycle or engine. The thermodynamic equation for its efficiency has been shown to exceed that of both the Otto and Diesel cycles over a wide range of operating conditions. The CIBAI cycle eliminates the need for spark/glow plugs or high-pressure cylinder fuel injectors, thereby enhancing its reliability. With the exception of an additional "cylinder-connecting valve" all other components used are standard for I.C. engines. The engine comprises conventional piston engine components such as: crankshaft in a casing, cylinders, pistons, carburetor or low pressure inlet manifold injection and the in case of 4-stroke engines cylinder head valves while for 2 stroke engines cylinder wall ports with crank-case compression. To enable operation on the CIBAI cycle the engine must have pairs of cylinders with pistons operating in phase with their cylinder heads in close proximity. For a single crankshaft configuration, each cylinder pair is mounted side-by-side inline with the crankshaft. If two crankshafts are used, then cylinders can be mounted head to head or in a V formation. One of the cylinders in each pair is used to compress an air-fuel mixture, with a volumetric compression ratio $r_{vaf}$, just short of knock level. The other cylinder compresses only air to high pressure and temperature with volumetric compression ratio $r_{va}$. One additional item is required, the cylinder connecting valve which upon opening should not alter the combined volume of the air-fuel mixture and hot air volume. This cylinder-connecting valve remains closed during most of the compression stroke, but opens near Top Dead Center. At that instant nearly all of the hot high-pressure air expands into the cylinder with the air-fuel mixture. The sudden compression and heating of the pre-evaporated air-fuel mixture causes spontaneous ignition near Top Dead Center. The combustion pressure rise transfers some of the combustion products back into the air-compressing cylinder. By the end of the expansion stroke each cylinder contains nearly the same amount of combustion products. The sudden rise in air-fuel mixture pressure just prior to ignition gives the CIBAI cycle a higher effective compression ratio than the Otto cycle. The CIBAI cycle constant volume heat addition renders it also more efficient than constant pressure burning Diesel cycles over most commonly used compression ratios. A comparison of ideal cycle efficiencies for the CIBAI-Otto- and Diesel cycles has been shown here assuming both pistons used in the CIBAI cylinder pair have the same displacement volume $V_o$.

The following efficiency controlling parameters have been kept equal for comparison purposes:

1) Polytropic compression and expansion coefficient n (used in: pV"=constant)

2) Air-fuel mixture piston volumetric compression ratio $$r_{vaf} = \frac{V_o + V_{2af}}{V_{2af}}$$

3) Air-only piston volumetric compression ratio $$r_{va} = \frac{V_o + V_{2a}}{V_{2a}}$$

4) Combustion induced temperature ratio $T_3/T_2=r_c$, called cut-off ratio in the diesel cycle.

The cycle efficiency of the three above-mentioned ideal cycles is shown below in closed form. For the spark-ignition Otto cycle find:

$$\eta_{th_{Otto}} = \frac{Q_{in} - Q_{out}}{Q_{in}} = 1 - \frac{1}{r_v^{n-1}}$$

For the compression ignition Diesel cycle find:

$$\eta_{th\ Diesel} = \frac{Q_{in} - Q_{out}}{Q_{in}} = 1 - \left(\frac{1}{r_v^{n-1}}\right)\left(\frac{r_c^n - 1}{n(r_c - 1)}\right)$$

For the compression ignition CIBAI cycle find the air to air-fuel mixture mass ratio to be:

$$r_m = \frac{r_{va}/(r_{va} - 1)}{r_{vaf}/(r_{vaf} - 1)}.$$

This mass ratio is needed together with the volume ratio of the combined two cylinder compression volume, $V_2$, divided by the displacement volume, $V_o$ of the air-fuel piston:

$$\frac{V_2}{V_o} = \frac{1}{(r_{vaf} - 1)} + \frac{1}{(r_{va} - 1)}.$$

Inserted below gives the CIBAI cycle efficiency as:

$$\eta_{th\ CIBAI} = \left[\frac{W_{out}}{Q_{in}} = \frac{r_c * (1 - ((V_2/V_o)/(V_2/V_o + 2))^{(n-1)})}{(r_c - 1)}\right] - \left[\frac{W_{in}}{Q_{in}} = \frac{r_{vaf}^{(n-1)} - 1 + (r_{va}^{(n-1)} - 1) * r_m}{(r_{vaf}^{(n-1)} + r_{va}^{(n-1)} * r_m) * (r_c - 1)}\right]$$

The herein disclosed "Compression Ignition Engine by Air Injection from Air-Only Cylinder to Adjacent Air-Fuel Cylinder", has two reasons why a throttle valve is not required to maintain an ignitable mixture at part power. First injecting air from the adjacent cylinder leans the mixture ratio by approximately a factor of two. Therefore the maximum fuel-air mixture ratio inside the fuel-air cylinder should be about double that used in the Otto cycle. Second, the ignition thermal energy provided by the detonation wave is enormous compared to the electric energy provided by a spark plug. Detonating a fuel-air mixture at top dead center provides constant volume heat addition and allows using mixtures of air with: gasoline, methane, kerosene, etc. which eliminates the need for high cetane number, high pressure fuel pump, fuel cylinder injectors and the Diesel engine cold starting problem.

Most service problems on Otto and Diesel engines are related to spark plug fouling or diesel injector wear, which makes the herein disclosed invention not only more fuel efficient, but also more reliable, and more economical to build and maintain. Another significant limitation of the Diesel engine is its minimum size. This is because its injector is unable to meter accurately very small quantities of fuel. The herein disclosed invention can operate efficiently in very small engines with only limitation being that is requires at least one pair of cylinders.

The high thermal efficiency and simplicity of the herein disclosed invention makes it very suitable for the automotive industry, stationary engines of all sizes, UAV aircraft engines to extend range, and for general aviation to eliminate the need for low lead 100 octane avgas.

Another important application of this new invention is to produce power with either a rich or lean hydrogen fuel charge. If such an engine has at least four cylinders, then one of the pair of cylinders can produce 1000 degree C. hydrogen rich exhaust to supply a solid oxide fuel cell, while the other pair extracts power from the gas exhausted from by the fuel cell, which still contains sufficient hydrogen for ignition.

Currently, gas engines using hydrogen or methane engines are best operated on the Otto spark ignition cycle, as its volume flow presents problems for Diesel cylinder injection. This means an air-fuel mixture must be compressed, with the usual pre-ignition and efficiency limitations of the spark ignition cycle. However, burning hydrogen in the herein disclosed CIEBAI engine is not only more efficient but much safer as hydrogen has such a high reaction rate that it can be compressed by itself in one cylinder while the ignition air is compressed in one or two adjacent cylinders. Then there will be no octane number limitation to the compression ratio used in either one of the cylinders. This means the engine can be made very efficient and safe, which would be ideal for the automotive industry.

This newly invented IC engine compresses air to very high pressure in one or more cylinders adjacent to those compressing a fuel-air mixture or just a gaseous fuel. The cylinders are isolated during compression stroke. Near top dead center, a cylinder-connecting valve (CCV) is opened to allow the high-pressure air in one of the cylinders to enter the fuel or fuel-air mixture in the other cylinder thereby inducing rapid ignition. There are six good reasons why all IC engines should be operated on the CIBAI cycle:

1. Maximize fuel efficiency all the way from maximum power to idle by eliminating the throttle valve. Detonation ignition at top dead center by high-pressure air injection increases the pressure of the combustion products throughout the expansion stroke and thus power output.
2. The increased ignition energy allows operation on a wide range of fuels without starting problems.
3. Reduce manufacturing cost and increase reliability of all IC engines by eliminating the need for spark plugs or high-pressure fuel injectors. Note service records show that spark or fuel injection ignition malfunction is the source of most frequently encountered repairs.

4. Allow compression ignition engines to be scaled down to the size of portable engines with displacement volumes of a few cubic centimeters. This is currently impossible with Diesel injectors, which are incapable of metering the very small quantities of fuel required.
5. Solve the long-standing air and lakes pollution problem by the use of inefficient two-cycle outboard motors, which have a poor scavenging record and spill some unburned fuel and lubricant out of their exhaust ports. This invention is most suitable for two-cycle engines as it renders them far less polluting. First it scavenges combustion products with clean air, out of the air-fuel cylinder, then via the cylinder-connecting valve out of the exhaust port at the base of the air-only cylinder.
6. For use as a chemical reactor to produce both power and high temperature hydrogen rich exhaust to supply solid oxide fuel cells. The same engine can also have some cylinders extract power from the hydrogen remaining in the fuel cell exhaust.

An internal combustion engine operating on the CIBAI cycle combined with a high temperature fuel cell yields a system which is capable providing high conversion of chemical energy in hydrogen-based fuels to a combination of electrical energy and shaft energy. The engine ingests hydrogen-based fuels in at least one reactor cylinder undergoing partial combustion to produce a hydrogen rich exhaust to be used as fuel for the high temperature fuel cell, such as a solid oxide fuel cell. As this hydrogen rich exhaust passes through the fuel cell reactor, part of the hydrogen is consumed to produce electrical energy, however, part of the hydrogen is exhausted from the fuel cell unreacted. This unreacted hydrogen from the fuel cell (normally on the order of several percent of the mixture) is then used as fuel for one or more other cylinder pairs to produce shaft power and to assure complete combustion of all hydrogen. This system is useful for maximizing the overall system energy conversion efficiency and for yielding useful forms of power as electrical power and shaft power.

BRIEF DESCRIPTION OF THE DRAWINGS

The drawings show some possible configurations of the herein claimed engine configurations and its calculated efficiency. The drawings are in no way meant to limit the physical configuration of the possible embodiments of internal combustion engines that may operate on the CIBAI cycle. One way to modify a conventional IC engine to operate on the herein described Compression Ignition by Air Injection CIBAI cycle requires the following modifications:

1. Remove the engine throttle valve, and ignition system such as spark plugs or cylinder fuel injectors.
2. Modify the crankshaft to ensure that each pair of cylinders moves in synchronization either side-by-side or opposing one another with their heads in close proximity to one another and with moving piston masses balanced.
3. Install a cylinder connecting valve (CCV), and a method for actuating this valve by mechanical, hydraulic, electric or pneumatic means.
4. Modify the head to ensure that, at the moment the cylinder-connecting valve opens, the air-only cylinder reaches a pressure higher than the pressure of the air-fuel mixture to be ignited. For rapid ignition, use an air pressure at least double that of the air-fuel mixture.
5. For a 4-stroke engine modify the air-only cylinder to take in only air.
6. For a 2-stroke engine modify the method of cylinder scavenging. Install all exhaust ports at the base of the air-only cylinder and route both an air-only inlet port and an air-fuel mixture inlet port to the base of the air-fuel cylinder. The port heights should be different such that the air-only port opens first to drive combustion products from the air-fuel cylinder through the cylinder-connecting valve. Next the air-fuel port opens to continue driving all exhaust products out of the air-only cylinder. Note this process prevents any unburned fuel from escaping though the exhaust ports.

DETAILED DESCRIPTION OF THE PREFERRED EMBODIMENT

In the preferred embodiment, to operate a piston internal combustion engine on the Compression Ignition By Air Injection (CIBAI) cycle requires at least one pair of pistons operating in phase, with their heads adjacent to one another. One of the pistons compresses an air-fuel mixture (or fuel only) to a pressure ratio limited by knock as in spark ignition engines. The other piston compresses only-air to high-pressure. When both pistons reach near Top-Dead-Center, the cylinder-connecting valve is opened without altering their combined compression volumes. As the high-pressure air volume is smaller, much of the air injects into the air-fuel mixture. The sudden compression causes the fuel-air mixture to detonate with the piston at top dead center or at constant volume. The combustion pressure rise pushes some of the combustion products back into the air cylinder. During the subsequent expansion stroke the cylinder-connecting valve remains open to equalize the pressure on both pistons. At Bottom Dead Center both cylinders contain approximately the same amount of combustion products. CIBAI cycle operation eliminates the need for spark plugs with their required high voltage source and eliminates the need for a high-pressure fuel pump with its fuel injectors. The CIBAI cycle thermal efficiency exceeds that of the Otto cycle due to increased pressure by air injection and exceeds that of the Diesel cycle because combustion takes place at constant volume instead of at constant pressure till the cut-off ratio is reached. The only additional needed component is the cylinder-connecting valve (CCV). This valve can be actuated either by mechanical, hydraulic or electric valve actuators (lifters) or by pneumatic pressure differences.

Figure 1:
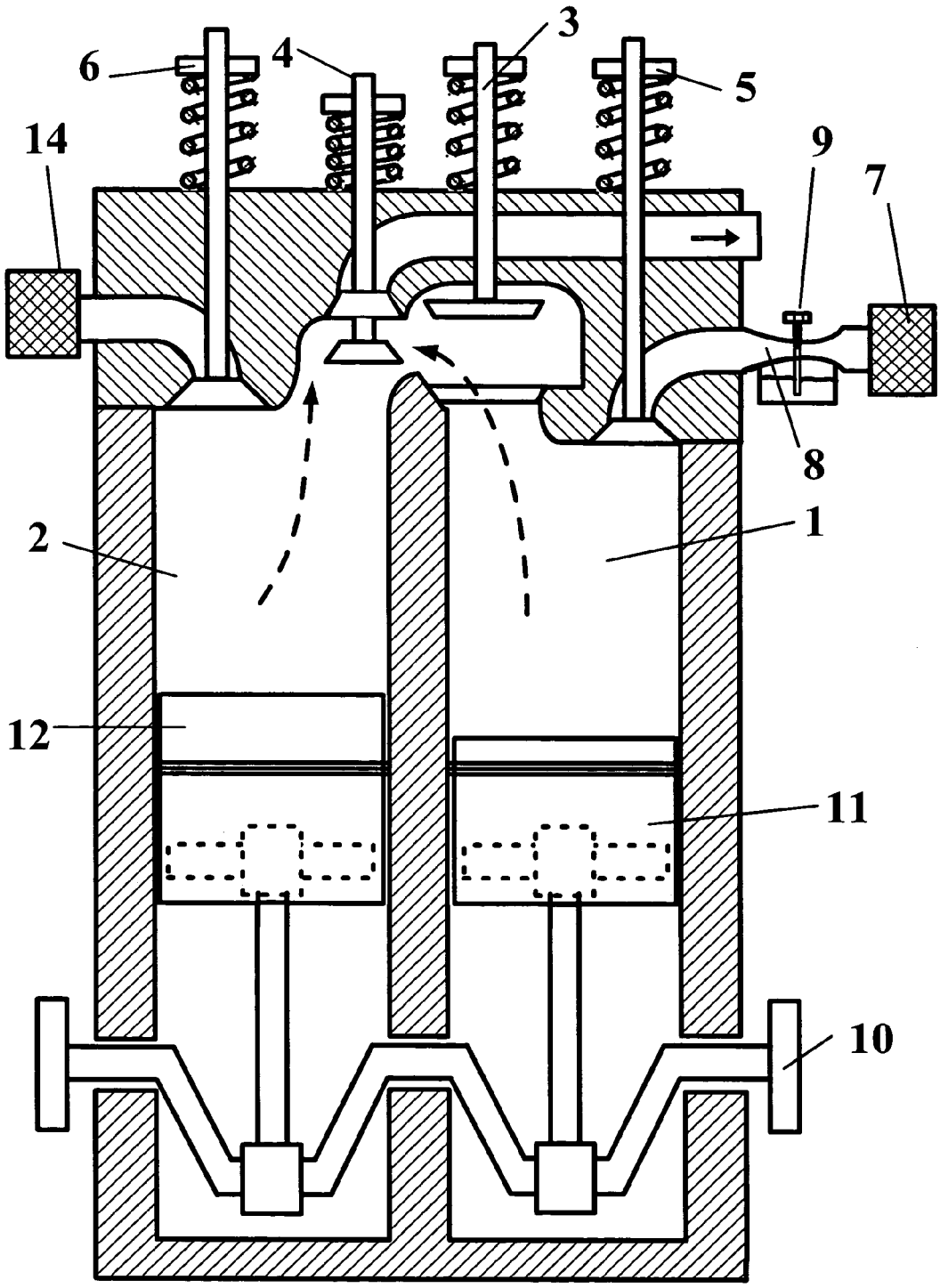
FIG. 1 is a schematic drawing of a pair of piston/cylinders, operating side-by-side on the CIBAI cycle in a 4-stroke engine. The right cylinder compresses an air-fuel mixture while the left cylinder compresses air to high pressure and temperature. Conventional spring loaded cylinder head valves may be used here for both air and air-fuel intakes as well as exhaust and for the cylinder-connecting valve.

FIG. 1 is a schematic drawing of a pair of piston/cylinders, operating side-by-side in phase on the CIBAI cycle in a 4-stroke engine. Cylinder 1 compresses an air-fuel mixture (or just fuel) while cylinder 2 compresses air to high pressure and temperature. Conventional type cylinder head valves are used here for both air and air-fuel intakes as well as exhaust and the cylinder-connecting valve. The configuration shown is at the start of the scavenging stroke when both the exhaust valve 4 and cylinder-connecting valve 3 are wide open. The dashed arrows show the direction of flow of exhaust gas from cylinders 1 and 2 and out of the one or more open exhaust valves 4. At the end of the scavenging stroke both the exhaust valve 4 and the cylinder-connecting valve 3 are closed. During the intake stroke an air-fuel mixture is generated in carburetor 8 with air from filter 7, the mixture enters through inlet valve 5 into cylinder 1. The carburetor fuel feed system could be replaced with a fuel injector system well known in the art (not shown). At full power, the fuel-air mixture ratio in cylinder 1 may be twice as rich as in an Otto cycle because it is going to be diluted with air injected from cylinder 2. Engine power is adjusted by fuel flow control with needle 9. Air enters into cylinder 2 through filter 14 and inlet valve 6. During the compression stroke the cylinder-connecting valve 3 remains closed. Near Top Dead Center a mechanical, hydraulic, pneumatic, or electric valve lifter is used to open the cylinder-connecting valve 3. This allows the high-pressure air inside cylinder 2 to compress, heat and ignite the pre-evaporated air-fuel mixture in cylinder 1. During combustion the pressure in cylinder 1 will rise to exceed that in cylinder 2, which causes flow reversal and combustion of any unburned fuel present in cylinder 2. Cylinder-connecting valve 3 remains open till the end of the expansion stroke to equalize the pressure in both cylinders. Near bottom dead center exhaust valve 4 opens and the sequence repeats itself. Power is extracted from crankshaft 10 which can support several pairs of pistons in a row.

Figure 2:
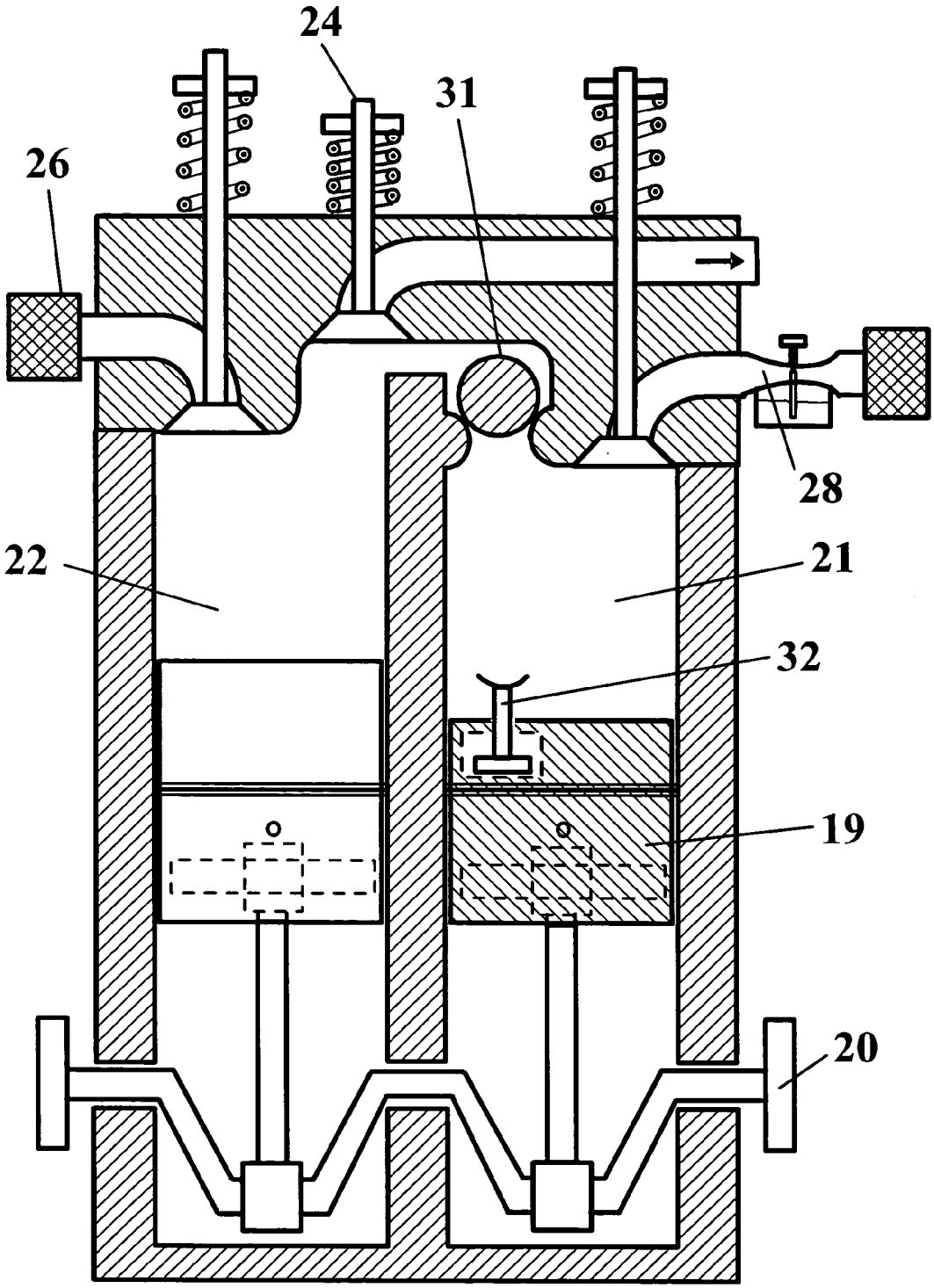
FIG. 2 is a schematic drawing of a pair of piston/cylinders, operating side-by-side on the CIBAI cycle in a 4-stroke engine. The right cylinder compresses an air-fuel mixture (or just gaseous fuel) while the left cylinder compresses air to high pressure and temperature. Conventional spring-loaded cylinder head in and outlet valves are shown. In this embodiment, the cylinder-connecting valve shown is a ball check-valve. It is opened either by a slight pressure difference between the two cylinders or at the moment of ignition by a pushrod installed in the air-fuel cylinder piston. Lifting this ball from its seat against high backpressure takes place in two stages. As the piston decelerates a golf-tee like pushrod extends from the piston and lands gently on the ball surface. As the piston reaches near top dead center, the base of this pushrod bottoms out inside its holder and then lifts the ball valve of its seat. This defines the opening of this cylinder-connecting valve. Then high-pressure air enters and detonates the fuel-air mixture.

FIG. 2 is a schematic drawing of a pair of piston/cylinders, operating side-by-side in phase on the CIBAI cycle in a 4-stroke engine. The right cylinder 21 compresses an air-fuel mixture while the left cylinder 22 compresses only air to high pressure and temperature. Conventional type cylinder head valves are used here for both air and air-fuel intakes as well as exhaust. Shown here is the start of the compression stroke with all valves closed. The ball check-type valve 31 is held closed both by gravity and by the pressure in cylinder 22 building up faster than in cylinder 21. Lifting this ball from its seat against high backpressure and the right crank angle takes place in two stages. As piston 19 decelerates a golf-tee like pushrod 32 extends from this piston and when close lands gently on ball 31 surface. As piston 19 reaches near top dead center, the base of pushrod 32 bottoms out inside its holder and then moving with the piston lifts the ball valve of its seat. This defines the opening of the cylinder-connecting valve 31. At that moment high-pressure air enters cylinder 21 followed by detonation ignition.

During combustion the pressure in cylinder 21 rises to exceed that in cylinder 22, which causes flow reversal and combustion of any fuel present in cylinder 22. During the expansion stroke the pressure in cylinder 22 drops faster then in cylinder 21. This pressure difference keeps ball valve 31 off its seat to nearly equalize the pressure in both cylinders. Near bottom dead center exhaust valve 24 opens and the sequence repeats itself. Power is extracted from crankshaft 20 which can support several pairs of pistons in a row. The intake stroke is conventional filling cylinder 22 with air from filter 26, and cylinder 21, with fuel-air mixture from carburetor 28.

Figure 3:
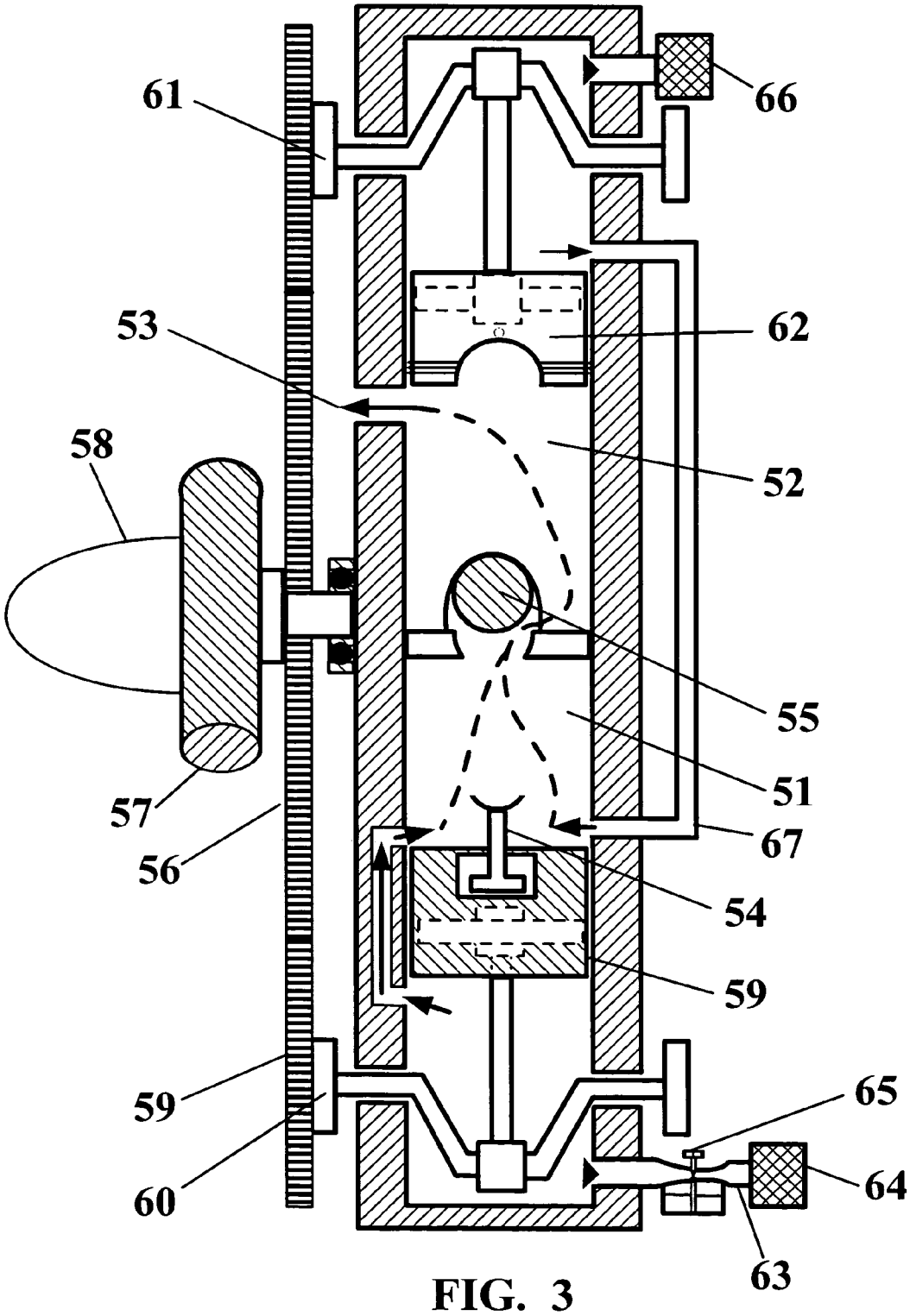
FIG. 3 is a schematic drawing of a pair of piston/cylinders, mounted end-to-end for a well-balanced operation on the CIBAI cycle in a 2-stroke engine. Scavenging is obtained by crankcase pressurized air and air-fuel discharging through ports at the base of the lower cylinder. First only air is released pushing out exhaust products out through the cylinder-connecting valve to the exhaust port. The delay in releasing the air-fuel mixture assures that no fuel escapes out of the exhaust ports. During the compression stroke, the cylinder-connecting valve is closed by both gravity and the pressure difference generated. The cylinder connecting ball-check valve shown here is opened in the same manner as described above in FIG. 2.

FIG. 3 shows a schematic of a 2-stroke engine with a pair of cylinders mounted end-to-end for optimum mass balance with pistons moving in phase. The intake and exhaust ports are opened by pistons 62 and 59 when at near Bottom Dead Center. The cylinder-connecting valve 55 is shown here as a ball check valve in a cage. The application shown here is for a small airplane engine. The central driveshaft 58 extracts power to a propeller 57 via a reduction gearing or chain drive from the two separate crankshafts 60 and 61. Piston 59 in cylinder 51 is shown at Bottom Dead Center position where cylinder 51 first fills up with compressed air from the crankcase of cylinder 52 via external pipe 67 while expelling exhaust products through the ball check valve 55 and out of port 53. Next, it fills cylinder 51 with a compressed air-fuel mixture from the crankcase of cylinder 51. This scavenges all remaining combustion products from cylinder 52 and out of exhaust port 53. Note as soon as scavenging is completed the cylinder-connecting valve 55 closes during the remainder of the compression stroke by both gravity and pressure differential created by the higher compression ratio in cylinder 52 than 51. In the second half of the compression stroke piston 59 decelerates such that pushrod 54, in the shape of a golf-ball tee, extends itself from piston 59. Its low inertia minimizes the landing impact on the ball surface 55. As the piston moves up further, plunger 54 lands on its base inside the cavity of piston 59. Then moving with the piston, the plunger lifts ball valve 55 of its seat to allow high-pressure air to enter from cylinder 52 followed by detonation ignition. During the expansion stroke the pressure differential keeps the cylinder-connecting valve remains open till Bottom Dead Center where the cycle repeats itself Note during the compression stroke, crankcase of cylinder 51 fills with an air-fuel mixture through filter 64 and carburetor 63 with fuel flow control by valve 65, and crankcase of cylinder 52 fills with an air through filter 66.

Figure 4:
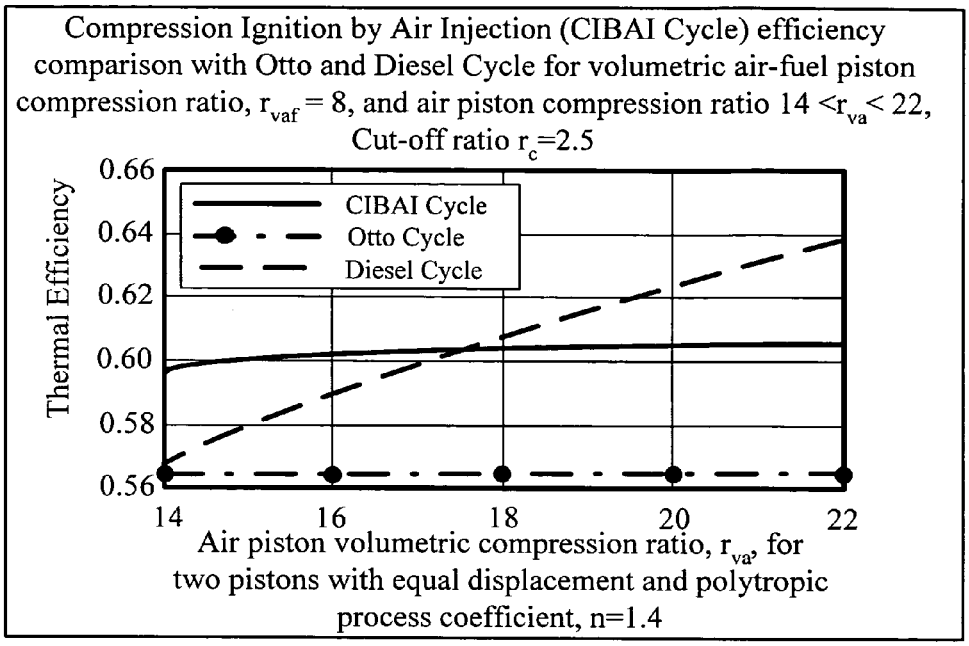
FIG. 4 shows a calculated efficiency for the ideal Otto, Diesel and CIBAI cycles, for an air-fuel compression ratio $r_v$, =8 over a range of air-only compression ratios.
Figure 5:
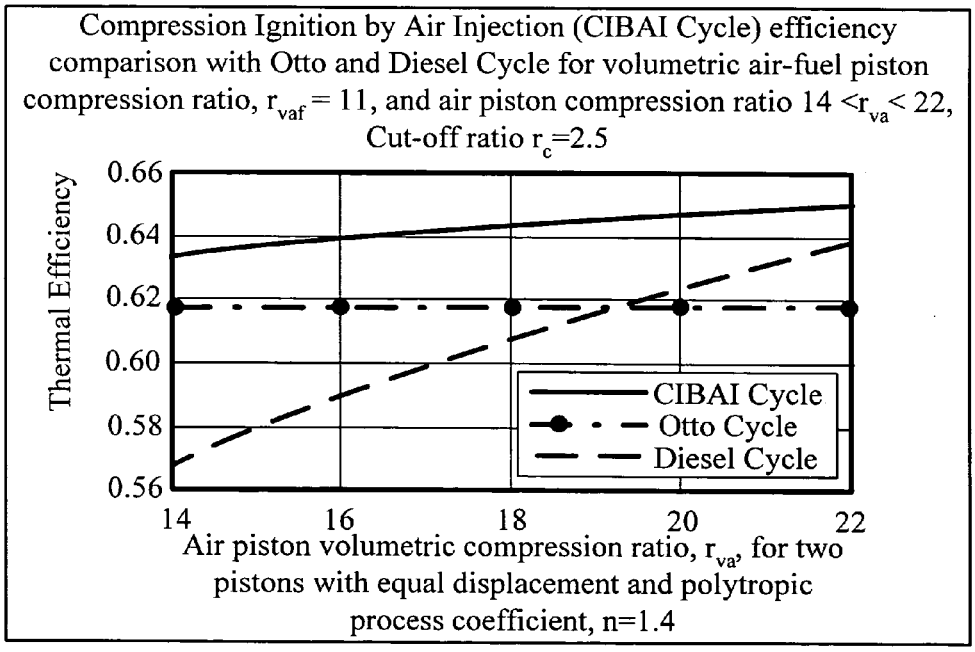
FIG. 5 shows a calculated efficiency for the ideal Otto, Diesel and CIBAI cycles, for an air-fuel compression ratio $r_v$, =11 over a range of air-only compression ratios.

FIGS. 4 and 5 are graphs comparing the theoretical efficiency of the Otto, Diesel and CIBAI cycles for certain set parameters. They are:

1. Polytropic compression and expansion coefficient n=1.4
2. Air-fuel mixture piston volumetric compression ratio $$r_{vaf} = \frac{V_o + V_{2af}}{V_{2af}}$$

shown equal to 8 in FIG. 4 and equal 11 in FIG. 5

3. Piston displacement volume ratio $V_0$ has been kept the same for both pistons.
4. Combustion induced temperature ratio, called cut-off ratio $r_c$ in diesel cycle is set at 2. The efficiency of the Diesel and CIBAI cycle are compared over the range of air-only compression ratios from: $14<r_{va}<22$. Of course Otto cycle efficiency depends only on air-fuel mixture compression ratio $r_{vaf}$. The CIBAI cycle efficiency shows to be higher than the others at an air-fuel mixture compression ratio $r_{vaf}=11$.

Figure 6:
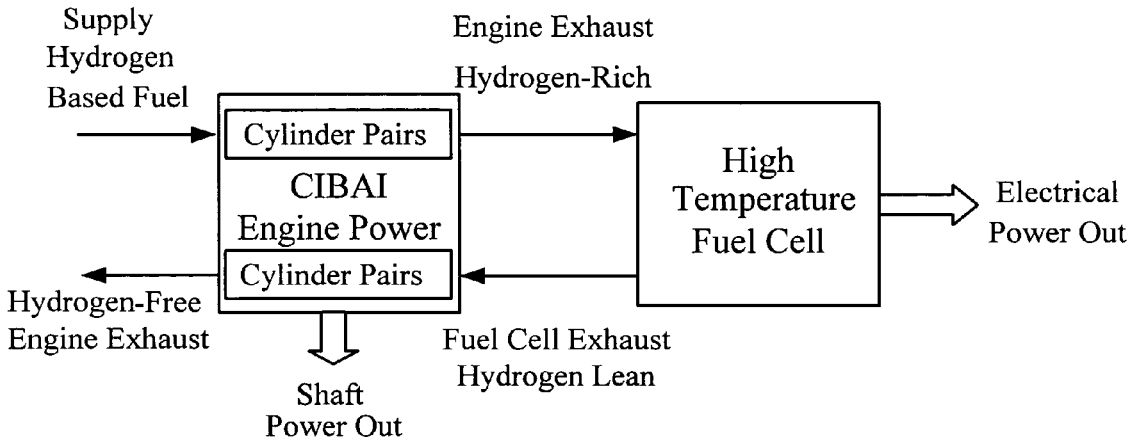
FIG. 6 shows a schematic diagram of the internal combustion engine operating on the CIBIA cycle combined with a high temperature fuel cell to form an energy efficient system.

The schematic diagram in FIG. 6 shows an internal combustion engine operating on the CIBAI cycle combined with a high temperature fuel cell to yield a system which is capable providing high conversion of chemical energy in hydrogen-based fuels to a combination of electrical energy and shaft energy.

In another embodiment, in order for the engine to operate at optimum efficiency over a wide range of fuels, the compression volume at top dead center of the cylinder(s) containing the air-fuel mixture can be modified mechanically, hydraulically, electrically, or pneumatically.

It is understood that the herein described piston-cylinder containing the fuel rich mixture may contain all fuel and no air in the limiting case of the fuel rich mixture definition. It is 2further understood that the piston cylinder apparatus described herein applies equally to the varying volume combustion chamber of rotary-type internal combustion engines.

We claim:

1. An internal combustion engine apparatus comprising of at least two cylinders with their heads in close proximity, and their pistons moving in synchronization towards top dead center, while compressing separately ignition air in at least one cylinder to very high pressure and an air-fuel mixture in at least one other cylinder to a high but knock free level, then toward the end of their compression strokes, a cylinder connecting valve is opened to allow the high pressure ignition air to enter cylinders containing said air-fuel mixture and igniting same by compression heating for the purpose of achieving explosive near constant volume combustion followed by an expansion stroke while said cylinder-connecting valve remains open to equalize the pressures acting on each piston and completing combustion of any remaining unburned fuel.

2. The apparatus of claim 1 wherein at least one cylinder-connecting valve is used to keep the pair of cylinders isolated during the compression stroke and means to connect said two cylinders rapidly near or at the end of their compression stroke without increasing the sum total of their two compression volumes and to remain open during at least the power expansion stroke and preferably during scavenging of the combustion products while actuating said valve by either mechanical, hydraulic, pneumatic or electric means as timed by the angular position of at least one crankshaft.

3. The apparatus of claim 1 wherein at least one cylinder-connecting valve is used to keep the pair of cylinders isolated during the compression stroke and means to connect said two cylinders rapidly near or at the end of their compression stroke without increase in the sum total of their two compression volumes and to remain open during at least the power expansion stroke and preferably during scavenging from combustion products while actuating said valve pneumatically by the aid of springs or pressure differences between the two cylinders or pressure in the crankcases in case of a two-stroke engine.

4. The apparatus of claim 1 wherein one or more cylinder-connecting valves are in the form of a ball check valve which remains open during the expansion stroke by a slightly higher pressure in the air-fuel cylinder than in the air only cylinder and is closed by the aid of gravity and the more rapidly rising pressure in the air-only cylinder than in the air-fuel cylinder, and is opened mechanically by a golf ball tee like plunger mounted on the air-fuel cylinder piston such that during deceleration in the latter half of the compression stroke said plunger extends away from the piston to gently contact the ball valve surface, which is followed by the plunger base bottoming out inside the piston which provides enough force to lift the ball of its seat at top dead center and allow the high pressure air to enter the air-fuel cylinder and ignite the air-fuel mixture.

5. The apparatus of claim 1 wherein the pre-evaporated air-fuel mixture is in general rich because an approximately equal amount of air is made available for combustion when it is injected near the end of the compression stroke when the cylinder connecting valve is opened, making this configuration operate like a compression ignited pre-mixed stratified charge engine, where its fuel-air mixture can be ignited without need for a throttle valve or ignition source including a spark plug or glow plug.

6. The apparatus of claim 1 wherein the chemical reaction between a gaseous, fuel rich combustible mixture or in the case of hydrogen fuel, with or without any air mixed in, is increased in temperature by partial combustion for the purpose of generating a source of high temperature hydrogen rich gas to power a solid oxide fuel cell.

7. The apparatus of claim 1 wherein near top dead center the air-fuel mixture in one cylinder is compressed by air injection, from at least second a cylinder in close proximity, to a pressure higher than achievable in conventional internal combustion engines, including spark ignition engines which are compression limited by pre-ignition, and fuel injected diesel engines which are pressure rise limited by fuel injection rate.

8. The apparatus of claim 1 wherein a pre-evaporated air-fuel mixture in one cylinder is compressed by injected air from at least a second cylinder in close proximity, thereby resulting in compression ignition of the air-fuel mixture.

9. The apparatus of claim 1 wherein the engine is a piston engine used for aircraft propulsion.

10. The apparatus of claim 1 wherein the at least two cylinders with their heads in close proximity further comprise a configuration selected from the group consisting of cylinders side-by-side, cylinders head-to-head inline, and cylinders head-to-head in a V-formation.

11. The apparatus in claim 1 wherein the engine is a four-stroke engine.

12. The apparatus in claim 1 wherein the engine is a two-stroke engine.

13. The apparatus in claim 1 wherein a two-stroke configuration both cylinders are scavenged via the connecting valve through the cylinder to be filled only with ignition air for the purpose of reducing the possibility of unburned fuel exiting with exhaust gases.

14. The apparatus of claim 1 wherein the compression volume at top dead center of at least one cylinder containing, the air-fuel mixture is modified mechanically, hydraulically, electrically, or pneumatically.

15. A method for operation of an internal combustion engine comprising the steps of:

positioning at least two piston-cylinder combinations in close proximity such that each cylinder head is connected to at least one other cylinder head by at least one passage, the opening and closing of which is controlled by at least one cylinder connecting valve; operating at least one piston-cylinder combination to ingest a rich mixture of fuel and ambient air or just hydrogen and to compress the mixture to a higher pressure than ambient but less than a pressure level to cause compression ignition of the mixture;

operating at least one other piston-cylinder combination to ingest ambient air and to compress the ambient air to a high pressure relative to both the ambient pressure and the maximum pressure within piston-cylinder combination containing the fuel rich mixture;

opening the cylinder connecting valve between the piston-cylinder combination containing the compressed air and the piston-cylinder combination containing the compressed fuel rich mixture when both piston positions are near top dead center;

initiating the combustion of the fuel rich mixture by rapid mixing and shock compression with inflow of the compressed air;

expanding products of combustion through all piston-cylinder combinations connected by the cylinder connecting valve by keeping this valve open until expansion of the products of combustion is complete.

16. The method of claim 15 further comprising:

extracting power from the internal combustion engine by means of at least one shaft connected to at least two piston-cylinder combinations.

17. The method of claim 15 wherein actuation of the cylinder-connecting valve is controlled by a method selected from the list including mechanically actuating, electromechanically actuating, pneumatically actuating, hydraulically actuating, electronically actuating, and any combination of these actuating methods.

18. A rotary-type internal combustion engine apparatus comprising at least one pair of adjacent rotors turning in synchronization towards their compression peak, while compressing separately ignition air in at least one rotor to very high pressure and an air-fuel mixture in at least one other adjacent rotor to a high but knock free level, then when reaching their peak pressure, a connecting valve is opened to allow the high pressure air to inject into the other rotor combustion chamber containing said air-fuel mixture and igniting same by compression heating for the purpose of achieving explosive near constant volume combustion followed by an expansion stroke while said connecting valve remains open to equalize the pressures acting on each piston and completing combustion of any remaining unburned fuel.

19. A method of operating an internal combustion engine conjunctively with a high temperature fuel cell comprising:

operating the engine on the CIBAI cycle;

extracting shaft power from the engine;

supplying hydrogen rich, engine exhaust gas to the fuel cell;

extracting electrical power from the fuel cell;

supplying hydrogen-laden exhaust gas from the fuel cell as gaseous fuel for the engine to produce additional shaft power.

20. A method of operating an internal combustion engine combined with a high temperature fuel cell comprising:

operating the engine on the CIBAI cycle in combination with at least one fuel cell;

providing shaft power output from the engine;

providing electric power output from the fuel cell;

powering both the engine and the fuel cell, at least partially, by the same fuel.

* * * * *